US009323176B2

(12) United States Patent
Terai et al.

(10) Patent No.: US 9,323,176 B2
(45) Date of Patent: Apr. 26, 2016

(54) POWDER SUPPLY DEVICE AND IMAGE FORMING APPARATUS INCORPORATING SAME

(71) Applicants: Junichi Terai, Kanagawa (JP); Hiroyuki Mabuchi, Kanagawa (JP); Yukio Otome, Ibaraki (JP); Hiroshi Kikuchi, Kanagawa (JP); Hiroaki Okamoto, Kanagawa (JP); Akira Fujimori, Kanagawa (JP); Tadashi Ogawa, Tokyo (JP); Hideki Kimura, Kanagawa (JP)

(72) Inventors: Junichi Terai, Kanagawa (JP); Hiroyuki Mabuchi, Kanagawa (JP); Yukio Otome, Ibaraki (JP); Hiroshi Kikuchi, Kanagawa (JP); Hiroaki Okamoto, Kanagawa (JP); Akira Fujimori, Kanagawa (JP); Tadashi Ogawa, Tokyo (JP); Hideki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/807,317

(22) Filed: Jul. 23, 2015

(65) Prior Publication Data

US 2016/0041498 A1 Feb. 11, 2016

(30) Foreign Application Priority Data

Aug. 11, 2014 (JP) ..... 2014-163269
Sep. 10, 2014 (JP) ..... 2014-183780

(51) Int. Cl.
*G03G 15/08* (2006.01)

(52) U.S. Cl.
CPC ..... *G03G 15/0865* (2013.01)

(58) Field of Classification Search
CPC ..... G03G 15/0865; G03G 15/0877; G03G 15/0886; G03G 15/0875; G03G 21/1676; G03G 15/0867; G03G 15/0879; G03G 15/0832; G03G 15/0868; G03G 15/0872; G03G 15/0834
USPC ..... 399/110, 258, 262
See application file for complete search history.

(56) References Cited

U.S. PATENT DOCUMENTS

| | | | | |
|---|---|---|---|---|
| 8,090,294 | B2 * | 1/2012 | Tanda | G03G 15/0896 399/110 |
| 2010/0215395 | A1 * | 8/2010 | Funada | G03G 21/1846 399/110 |
| 2011/0058857 | A1 | 3/2011 | Hori et al. | |
| 2011/0064478 | A1 * | 3/2011 | Yamaguchi | G03G 15/0879 399/262 |
| 2012/0033998 | A1 | 2/2012 | Hori et al. | |
| 2012/0207492 | A1 | 8/2012 | Fujiwara et al. | |
| 2012/0219326 | A1 | 8/2012 | Koike et al. | |
| 2012/0321341 | A1 | 12/2012 | Hori et al. | |
| 2013/0034368 | A1 | 2/2013 | Hattori et al. | |
| 2013/0045029 | A1 | 2/2013 | Kimura et al. | |
| 2013/0064570 | A1 | 3/2013 | Yamane et al. | |
| 2014/0064794 | A1 | 3/2014 | Takahashi et al. | |
| 2014/0119780 | A1 | 5/2014 | Hori et al. | |
| 2014/0248061 | A1 * | 9/2014 | Takami | G03G 15/0887 399/13 |
| 2014/0320906 | A1 | 10/2014 | Fujimori et al. | |

(Continued)

FOREIGN PATENT DOCUMENTS

| | | |
|---|---|---|
| JP | 11-231630 | 8/1999 |
| JP | 2013-257458 | 12/2013 |

*Primary Examiner* — Francis Gray
(74) *Attorney, Agent, or Firm* — Oblon, McClelland, Maier & Neustadt, L.L.P.

(57) ABSTRACT

A powder supply device to supply powder to a supply destination includes a body, a single holder including multiple mounts on which multiple powder containers are removably mounted respectively, and a reservoir disposed in the body and below the single holder to store powder discharged from the multiple powder containers; and the single holder is removably attachable to the body of the powder supply device including the reservoir.

9 Claims, 7 Drawing Sheets

(56) References Cited

U.S. PATENT DOCUMENTS

| | | | |
|---|---|---|---|
| 2014/0321885 | A1 | 10/2014 | Fujimori et al. |
| 2014/0321886 | A1 | 10/2014 | Kikuchi et al. |
| 2014/0341618 | A1 | 11/2014 | Otome et al. |
| 2014/0376951 | A1 | 12/2014 | Ogawa et al. |
| 2014/0376970 | A1 | 12/2014 | Kimura et al. |
| 2015/0023700 | A1 | 1/2015 | Nakamoto et al. |
| 2015/0043946 | A1 | 2/2015 | Takami et al. |
| 2015/0063875 | A1* | 3/2015 | Ohshima ..... G03G 15/0867 399/258 |
| 2015/0147096 | A1 | 5/2015 | Hori et al. |

* cited by examiner

POWDER SUPPLY DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2014-163269, filed on Aug. 11, 2014, and 2014-183780, filed on Sep. 10, 2014, in the Japan Patent Office, the entire disclosure of each of which is hereby incorporated by reference herein.

BACKGROUND

1. Technical Field

Embodiments of the present invention generally relate to a powder supply device to supply powder to a supply destination and an image forming apparatus, such as a copier, a printer, a facsimile machine, or a multifunction peripheral (MFP) having at least two of copying, printing, facsimile transmission, plotting, and scanning capabilities, that includes the powder supply device.

2. Description of the Related Art

Among image forming apparatuses, such as copiers, printers, facsimile machines, or MFPs, there are image forming apparatuses that include a toner supply device in which multiple toner containers are removably mounted for containing an identical color toner (powder).

SUMMARY

An embodiment of the present invention provides a powder supply device to supply powder to a supply destination. The powder supply device includes a body, a single holder including multiple mounts on which multiple powder containers are removably and respectively mounted, and a reservoir disposed in the body and below the single holder, to store powder discharged from the multiple powder containers. The single holder is removably attachable to the body of the powder supply device including the reservoir.

In another embodiment, an image forming apparatus includes an image bearer on which an image is formed with developer, and the powder supply device described above.

In yet another embodiment, an image forming apparatus includes multiple powder supply devices to supply powder to respective supply destinations, and each of the multiple powder supply devices is configured as described above. The holders of the multiple powder supply devices are arranged in a lateral direction perpendicular to a container insertion direction in which the powder containers are inserted into the powder supply device.

The holder of each of the multiple powder supply devices includes a first handle and a second handle disposed outside an area occupied by the multiple powder containers being inserted into or removal from the multiple mounts. The first handle and the second handle project upward from ends of the holder in the lateral direction and are disposed at different positions from each other in the container insertion direction.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
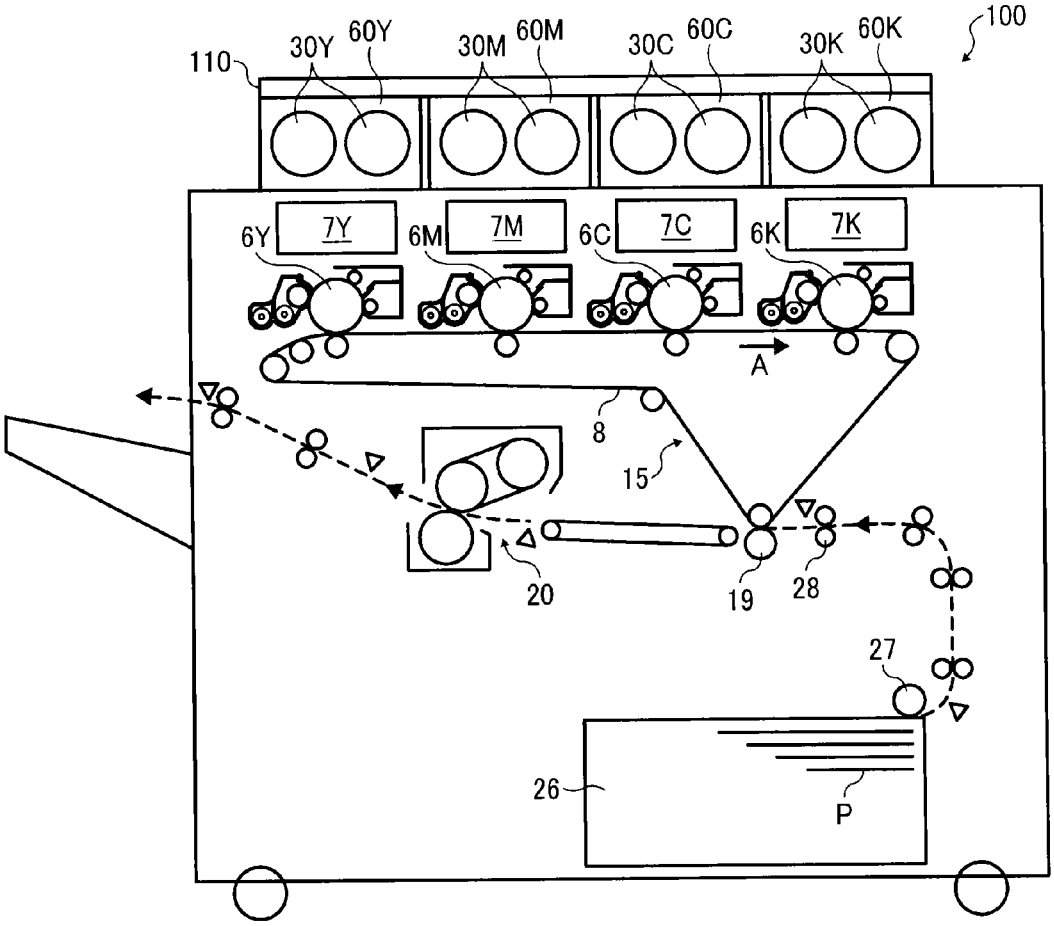
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be understood that an identical or similar reference character is given to identical or corresponding parts throughout the drawings, and redundant descriptions are omitted or simplified below. Additionally, the suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
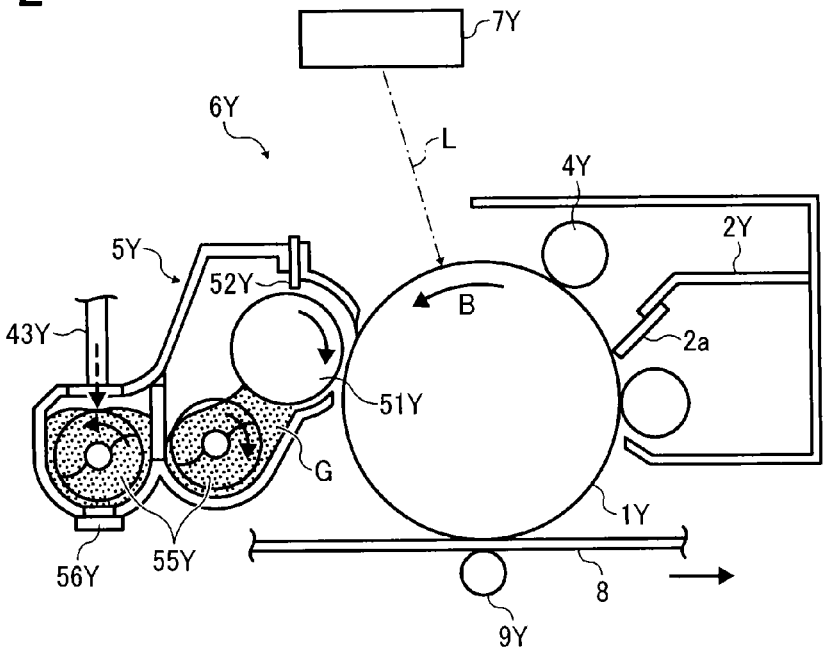
FIG. 2 is a schematic end-on axial view illustrating an image forming unit included in the image forming apparatus illustrated in FIG. 1.

Referring now to FIGS. 1 and 2, a configuration and operation of an image forming apparatus 100 according to an embodiment is described below.

FIG. 1 is a schematic view of the image forming apparatus 100, which in the present embodiment is a printer, for example. FIG. 2 is an image forming unit 6 of the image forming apparatus 100.

As illustrated in FIG. 1, toner supply devices 60Y, 60M, 60C, and 60K (i.e., powder supply devices) are provided in an upper part of a body of the image forming apparatus 100. In the toner supply devices 60Y, 60M, 60C, and 60K, two toner containers 30Y for yellow, two toner containers 30M for magenta, two toner containers 30C for cyan, and two toner containers 30K for black are respectively removably mounted. The toner containers 30Y, 30M, 30C, and 30K serve as powder containers and are substantially cylindrical in the present embodiment. Below the toner supply devices 60Y, 60M, 60C, and 60K (powder supply devices), image forming units 6Y, 6M, 6C, and 6K, respectively corresponding to yellow, magenta, cyan, and black, are disposed facing an intermediate transfer device 15 with exposure devices 7Y, 7M, 7C, and 7K interposed therebetween.

Referring to FIG. 2, the image forming unit 6Y for yellow includes a photoconductor drum 1Y serving as an image bearer and further includes a charging device 4Y, a developing device 5Y, a cleaning device 2Y, a discharger, and the like provided around the photoconductor drum 1Y. Image forming processes, namely, charging, exposure, development, transfer, and cleaning processes are performed on the photoconductor drum 1Y, and thus a yellow toner image is formed on the photoconductor drum 1Y.

It is to be noted that other image forming units 6M, 6C, and 6K have a similar configuration to that of the yellow image forming unit 6Y except the color of the toner used therein and form respective color toner images. Thus, only the image forming unit 6Y is described below and descriptions of other image forming units 6M, 6C, and 6K are omitted.

Referring to FIG. 2, the photoconductor drum 1Y is rotated counterclockwise in FIG. 2 by a driving motor. A surface of the photoconductor drum 1Y is charged uniformly at a position facing the charging device 4Y by the charging device 4Y (a charging process).

When the photoconductor drum 1Y reaches a position to receive a laser beam L emitted from the exposure device 7 (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the latent image is developed with toner into a yellow toner image (a development process).

When the surface of the photoconductor drum 1Y carrying the toner image reaches a position facing a primary transfer roller 9Y via an intermediate transfer belt 8, the toner image is transferred therefrom onto the intermediate transfer belt 8 (a primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process).

Subsequently, the discharger removes residual potential from the surface of the photoconductor drum 1Y.

Thus, a sequence of image forming processes performed on the photoconductor drum 1Y is completed.

The above-described image forming processes are performed in the image forming units 6M, 6C, and 6K similarly to the yellow image forming unit 6Y. That is, the exposure devices 7M, 7C, and 7K disposed above the image forming units 6M, 6C, and 6K in FIG. 1 direct the laser beams L according to image data onto the photoconductor drums 1M, 1C, and 1K in the image forming units 6M, 6C, and 6K. Specifically, each exposure device 7 includes a light source to emit the laser beams L, multiple optical elements, and a polygon mirror that is rotated by a motor. The exposure device 7 directs the laser beams L to the photoconductor drum 1 via the multiple optical elements while deflecting the laser beams L with the polygon mirror.

Then, the toner images formed on the respective photoconductor drums 1 through the development process are primarily transferred therefrom and superimposed one on another on the intermediate transfer belt 8. Thus, a multicolor toner image is formed on the intermediate transfer belt 8.

In FIG. 1, the intermediate transfer device 15 includes the intermediate transfer belt 8, the four primary transfer rollers 9, a driving roller, a secondary transfer backup roller, multiple tension rollers, a cleaning backup roller, a belt cleaner, and a secondary transfer roller 19. The intermediate transfer belt 8 is supported by multiple rollers and rotated in the direction (clockwise), indicated by arrow A illustrated in FIG. 1, as one (the driving roller) of the multiple rollers rotates.

Specifically, the four primary transfer rollers 9 are pressed against the corresponding photoconductor drums 1 via the intermediate transfer belt 8, and four contact portions between the primary transfer rollers 9 and the corresponding photoconductor drums 1 are hereinafter referred to as primary transfer nips. A transfer voltage (a primary transfer bias) opposite in polarity to toner is applied to each primary transfer roller 9.

The intermediate transfer belt 8 rotates in the direction indicated by arrow A in FIG. 1 and passes through the primary transfer nips sequentially. Then, the single-color toner images are transferred from the respective photoconductor drums 1 primarily and superimposed one on another on the intermediate transfer belt 8.

Then, the intermediate transfer belt 8 carrying the multicolor toner image reaches a position facing the secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a sheet P (a recording medium) transported to the secondary transfer nip (a secondary transfer process). A certain amount of toner tends to remain untransferred on the intermediate transfer belt 8 after the secondary transfer process.

When the intermediate transfer belt 8 reaches a position facing the belt cleaner, untransferred toner is collected from the intermediate transfer belt 8 by the belt cleaner.

Thus, a sequence of image forming processes performed on the intermediate transfer belt 8 is completed.

Referring back to FIG. 1, the sheet P is transported by a sheet feeder 26 provided in a lower portion of the image forming apparatus 100 to the secondary transfer nip via a sheet feeding roller 27, and a registration roller pair 28.

Specifically, the sheet feeder 26 contains multiple sheets P piled one on another. The sheet feeding roller 27 rotates counterclockwise in FIG. 1 to feed the sheet P on the top contained in the sheet feeder 26 toward a nip of the registration roller pair 28.

The registration roller pair 28 stops rotating temporarily, stopping the sheet P with a leading edge of the sheet P stuck in the nip. The registration roller pair 28 resumes rotating to transport the sheet P to the secondary transfer nip, timed to coincide with the arrival of the multicolor toner image formed on the intermediate transfer belt 8. Thus, the multicolor toner image is recorded on the sheet P.

The sheet P carrying the multicolor toner image is transported to a fixing device 20. In the fixing device 20, a fixing belt and a pressing roller apply heat and pressure to the sheet P to fix the multicolor toner image on the sheet P.

Subsequently, the sheet P is discharged by a pair of ejection rollers outside the image forming apparatus 100 and stacked as an output image in a stack section.

Thus, a sequence of image forming processes performed in the image forming apparatus 100 is completed.

Next, a configuration and operation of the developing device 5 (supply destination of powder) of the image forming unit 6 is described in further detail below with reference to FIG. 2.

The developing device 5Y, serving as the supply destination of powder, includes a developing roller 51Y disposed facing the photoconductor drum 1Y, a doctor blade 52Y disposed facing the developing roller 51Y, two conveying screws 55Y disposed in developer containing compartments, a supply path 43Y communicating with the developer containing compartment via an opening, and a concentration detector 56Y to detect concentration or density of toner in developer G. The supply path 43Y is made of a pipe or tube, which can be cylindrical, square, oval, or polygonal in cross section. The developing roller 51Y includes a magnet or a magnet roller fixed in position relative to the casing of the developing device 5Y, a sleeve that rotates around the magnet, and the like. The developer containing compartments contain two-component developer G including carrier (carrier particles) and toner (toner particles).

The developing device 5Y configured as described above operates as follows.

The developing sleeve of the developing roller 51Y rotates in the direction indicated by arrow B illustrated in FIG. 2. The developer carried on the developing roller 51Y by the magnetic field generated by the magnets moves in the circumferential direction of the developing roller 51Y as the developing sleeve rotates.

The developer G in the developing device 5Y is adjusted to keep the ratio of toner to carrier (toner concentration) within a predetermined range. Specifically, according to the consumption of toner in the developing device 5Y (the supply destination), the toner supply device 60Y (illustrated in FIG. 3) supplies toner (i.e., powder) from the toner container 30Y, and the toner is supplied to the developing device 5Y (the developer containing compartment) via a reservoir 66 of the toner supply device 60Y and the supply path 43Y. The configuration and operation of the toner container 30 and the toner supply device 60 are described in detail later.

While being stirred with the developer G and circulated by the two conveying screws 55Y in the developing device 5Y (developer containers), the supplied toner is circulated between the two developer containing compartments in a longitudinal direction of the developing device 5Y, which is perpendicular to the surface of the paper on which FIG. 2 is drawn. The toner in developer G is charged by friction with carrier and electrostatically attracted to the carrier. Then, the toner is carried on the developing roller 51Y together with the carrier by a magnetic force generated on the developing roller 51Y.

The developer G carried on the developing roller 51Y is transported in conformity to the direction of rotation of the sleeve to the doctor blade 52Y. The amount of developer G on the developing roller 51Y is adjusted to by the doctor blade 52Y, after which the developer G is carried to the developing range facing the photoconductor drum 1Y. Then, the toner is attracted to the latent image on the photoconductor drum 1Y by the magnetic field generated in the development range. As the sleeve rotates, the developer G remaining on the developing roller 51Y reaches an upper part of the developer containing compartment and drops from the developing roller 51Y.

Next, descriptions are given below of the toner container 30 containing toner supplied to the developing device 5 (supply destination) with reference to FIGS. 3, 4, and 5.

As described above with reference to FIG. 1, in each of the four powder supply devices, namely, each of the toner supply devices 60Y, 60M, 60C, and 60K, the two toner containers 30 (30Y, 30M, 30C, or 30K) are removably mounted. It is to be noted that, when the service life of each of the toner containers 30Y, 30M, 30C, and 30K has expired, that is, when almost all toner in the toner container 30 have been consumed, the old one is replaced with a new one. Each toner supply device 60 supplies the toner from the corresponding toner containers 30 to the developing device 5 of the corresponding image forming unit 6.

In the present embodiment, two toner containers are used for an identical color toner. Accordingly, a large amount of toner is contained as a whole without increasing the capacity of each toner container.

The two toner containers 30 (for example, 30Y) for an identical color toner are similar in configuration. Additionally, the toner containers 30M, 30C, and 30K for respective color toners are similar configuration to the toner containers 30Y except the color of toner contained therein. Therefore, one of the toner containers 30Y for yellow is described below, and descriptions of the toner containers 30M, 30C, and 30K for other colors are omitted.

Figure 3:
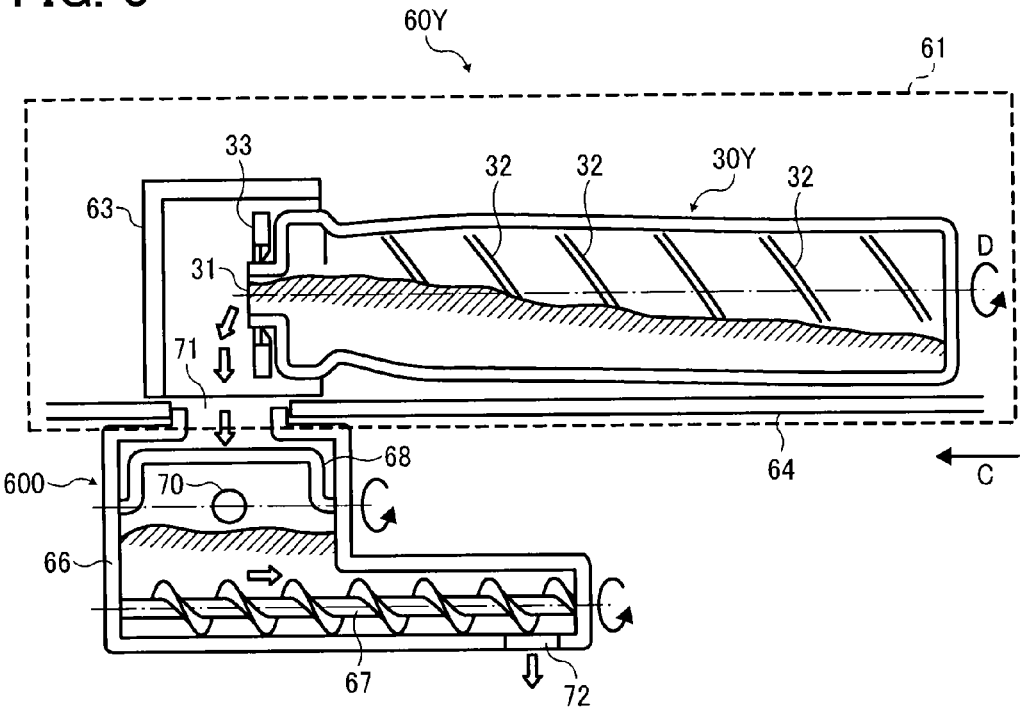
FIG. 3 is a schematic diagram illustrating a toner supply device in which two toner containers are mountable, according to an embodiment.
Figure 4:
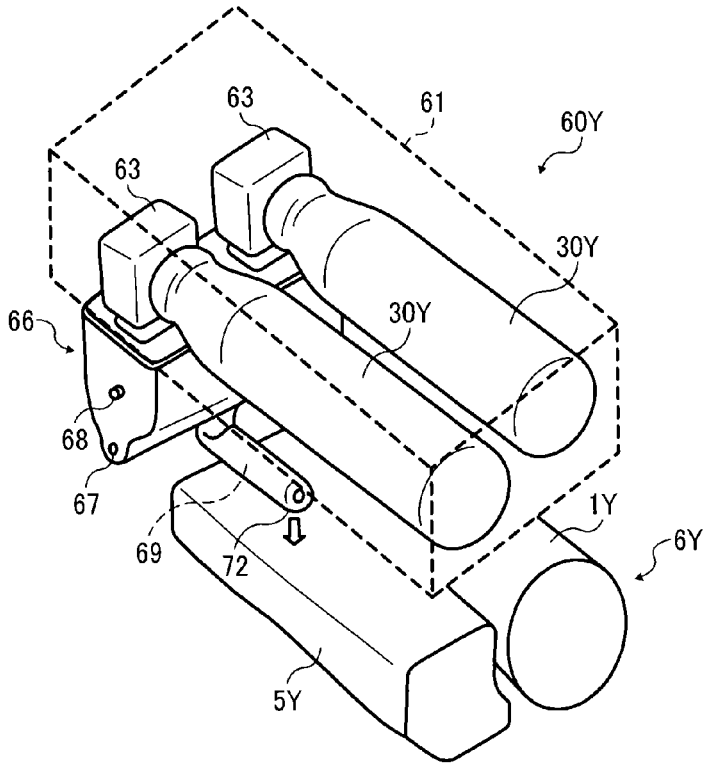
FIG. 4 is a schematic perspective view illustrating two toner containers mounted in the toner supply device illustrated in FIG. 3.

As illustrated in FIG. 3, the toner container 30Y includes a container body, which is substantially cylindrical in the present embodiment, and a cap to close an opening 31 of the container body. It is to be noted that, in this specification, the term "substantially cylindrical" includes polygonal shapes.

The opening 31 (toner outlet) is situated in a head of the container body. The head is at a leading end or distal side in the direction indicated by arrow C, in which the toner container 30Y is inserted into the toner supply device 60Y (hereinafter "insertion direction C"). Additionally, a bottle gear 33 that rotates together with the container body is provided in the head of the container body. The toner supply device 60Y includes a driving gear to rotate the container body in the direction indicated by arrow D, around a rotary axis (indicated by alternate long and short dashed lines in FIG. 3), and the bottle gear 33 engages the driving gear of the toner supply device 60Y. The opening 31 is for discharging toner from the container body to a space inside a head cover 63 and further to the reservoir 66.

The container body includes a spiral protrusion 32 protruding from an outer circumferential face to an inner circumferential face thereof. In other words, a spiral groove is provided in the outer circumferential face of the container body. The spiral protrusion 32 is for discharging toner from the container body through the opening 31 of the toner container 30Y by rotation of the container body. For example, the container body is produced using blow molding together with the bottle gear 33.

Being clamped by a chuck disposed in the toner supply device 60Y, the cap of the toner container 30Y opens and closes the opening 31 in conjunction with insertion and removal of the toner container 30Y into the toner supply device 60Y. That is, in a state in which the toner container 30Y is held in the toner supply device 60Y, the cap is removed from the opening 31 to enable discharge of toner from the toner container 30Y as illustrated in FIG. 3. By contrast, when the toner container 30Y is removed from the toner supply device 60Y, the cap is fitted to the opening 31 of the toner container 30Y to seal the opening 31.

The toner containers 30Y are inserted into and removed from the toner supply device 60Y of the image forming apparatus 100 as follows.

Figure 5:
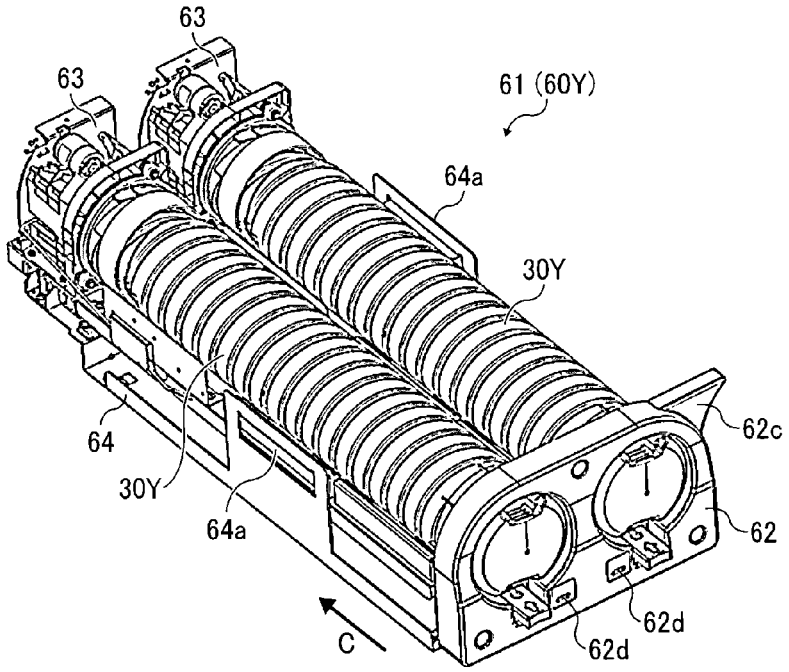
FIG. 5 is a perspective view of a two-mount holder of the toner supply device illustrated in FIG. 3, in which the two toner containers are mounted.

Referring to FIG. 5, the toner supply device 60Y includes a double-mount holder 61 (i.e., a single holder including multiple mounts) that includes an end support 62 (upstream end support) positioned on a trailing end of the toner supply device 60Y in the insertion direction C.

To mount the toner container 30Y in the toner supply device 60Y, initially a front cover (in FIG. 1) of the image forming apparatus 100 is opened to expose the end support 62 of the double-mount holder 61 in the toner supply device 60Y on the front side of the image forming apparatus 100. Insert the toner container 30Y from the entrance 62*b* (see FIG. 7) of the end support 62 in the insertion direction C, and fit, to the head cover 63, the head of the toner container 30Y including the opening 31. Then, the toner container 30Y is rotatably placed on one of two mounts 65 of the double-mount holder 61, and insertion of the toner container 30Y is completed. At that time, the bottle gear 33 engages the driving gear of the toner supply device 60Y. Then, the toner supply device 60Y can guide the toner contained in the toner container 30Y mounted in the toner supply device 60Y to the developing device 5Y (supply destination).

By contrast, in removal of the toner container 30Y from the toner supply device 60Y, the above-described processes are performed in reverse.

Next, a configuration of the toner supply devices 60 is described below.

Figure 7:
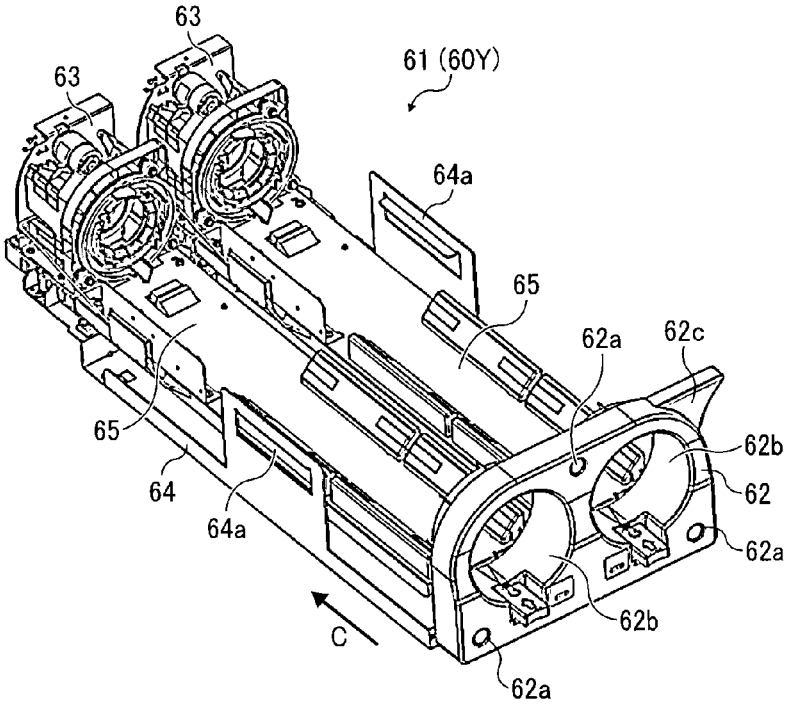
FIG. 7 is a perspective view of the two-mount holder illustrated in FIG. 5.

It is to be noted that, in FIG. 3, the orientation of the reservoir 66 relative to the toner container 30Y is different by 90 degrees and components of the reservoir 66 are simplified for ease of understanding. In FIG. 7, the exposure device 7Y illustrated in FIGS. 1 and 2 are omitted for simplicity.

It is to be noted that the toner supply devices 60Y, 60M, 60C, and 60K corresponding to different color toners have a similar structure except the color of toner. Therefore, only the structure for yellow is described below, and descriptions of the structures for other colors are omitted.

The toner supply device 60Y (the powder supply device) supplies toner from the toner containers 30Y to the developing device 5Y as the supply destination and is disposed above the body of the image forming apparatus 100.

In the toner supply device 60Y, the reservoir 66 is situated below the double-mount holder 61, in which the two toner containers 30Y are held. Toner discharged from the two toner containers 30Y drops through the head cover 63 to the reservoir 66 and stored therein. The reservoir 66 includes a first conveying screw 67, an agitator 68, a second conveying screw 69 (in FIGS. 4, 6A, and 6B), and a toner sensor 70. The reservoir 66 is situated on the back side of the image forming apparatus 100 and thee leading side in the insertion direction C (on the back side of the paper on which FIG. 1 is drawn).

Figure 6A:
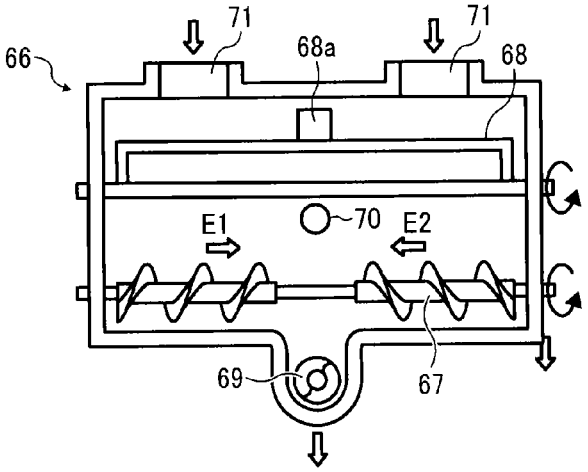
FIG. 6A is a schematic cross-sectional view of a reservoir of the toner supply device illustrated in FIG. 3, as viewed from a front side.
Figure 6B:
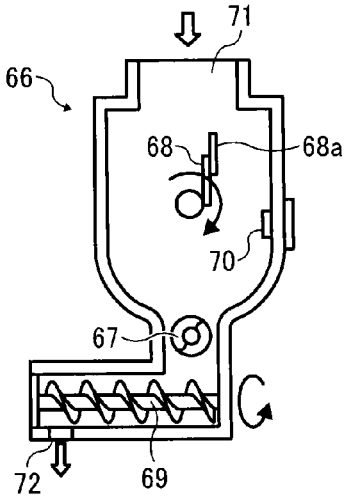
FIG. 6B is a cross-sectional view of the reservoir as viewed from a lateral side.

As illustrated in FIGS. 6A and 6B, above the reservoir 66, two inlets 71 are disposed. Toner flows from the head covers 63, which communicate with the respective openings 31 of the two toner containers 30Y, into the inlets 71 of the reservoir 66.

The first conveying screw 67, the agitator 68, and the second conveying screw 69 are disposed in a lower part of the reservoir 66. The first conveying screw 67 transports the toner flowing from the two inlets 71 to a center part of the reservoir 66 in a lateral direction perpendicular to the insertion direction C (in FIG. 7). The agitator 68 agitates the toner stored in the reservoir 66. The second conveying screw 69 transports the toner from the center part in the longitudinal direction of the toner container 30Y to an outlet 72 (illustrated in FIGS. 3, 4, and 6B). The first conveying screw 67 includes a shaft, which extends in the lateral direction perpendicular to the insertion direction C, and two screw portions (spiral blades) positioned in first and second end sides in an axial direction of the first conveying screw 67. The two screw portions wind around the shaft in the opposite directions to transport toner from the first and second end sides to the center part in the axial direction (as indicated by arrows E1 and E2 in FIG. 6A). The second conveying screw 69 includes a shaft, which extends in the longitudinal direction of the toner container 30Y, and a screw blade winding around the shaft to transport toner to the outlet 72 from the center part in the lower part of the reservoir 66. The outlet 72 of the reservoir 66 communicates with the developing device 5Y via the supply path 43Y illustrated in FIG. 2. As the second conveying screw 69 rotates, the toner flows out from the outlet 72 of the reservoir 66, and the toner is supplied to the developing device 5Y through the supply path 43Y.

At a middle height in the reservoir 66 in FIGS. 6A and 6B, the agitator 68 to stir the toner in the reservoir 66 and the toner sensor 70 are disposed. The toner sensor 70 detects the amount of toner to keep the height of toner in the reservoir 66 constant.

The agitator 68 includes a shaft and a substantially U-shaped rod provided to the shaft. A flexible sheet 68*a* made of plastic sheet such as Mylar® (registered trademark of DuPont) is attached to a center portion of the rod. As the agitator 68 rotates, the flexible sheet 68*a* slidingly contacts a detection face of the toner sensor 70 to clean the detection face.

The toner sensor 70 is, for example, a piezoelectric sensor and configured to detect the presence of toner at that position. When the toner sensor 70 does not detect toner, the toner container 30Y is driven to supply toner from the toner container 30Y to the reservoir 66. When the toner sensor 70 continues to indicate that toner is not present even though such a supply operation is performed, the toner container 30Y is deemed empty or substantially empty (the end of toner). Then, a display of the image forming apparatus 100 displays that.

The toner container 30Y (container body) and the second conveying screw 69 are rotated to discharge toner or transport toner, basically, in accordance with consumption of toner in the developing device 5Y. Specifically, when the concentration detector 56Y illustrated in FIG. 2 detects that the concentration of toner in developer G in the developing device 5Y is insufficient, a controller of the image forming apparatus 100 sends a signal to drive the driving motor (at least one of the driving motors to dive the respective toner containers 30Y), and additionally the driving motor to drive the second conveying screw 69 is driven. It is to be noted that the driving motor to drive the first conveying screw 67 and the agitator 68 operates, either continuously or intermittently at regular intervals, independently of the detection result by the concentration detector 56Y.

As described above, the spiral protrusion 32 is disposed on the inner circumferential face of the container body of the toner container 30Y. With this configuration, as the container body (toner container 30Y) rotates, toner is transported from the bottom side of the toner container 30Y (upstream side in the insertion direction C) to the opening 31 on the head side, and the toner discharged through the opening 31 flows down the head cover 63 into the reservoir 66 through the inlets 71.

The toner stored in the reservoir 66 is discharged from the outlet 72 and supplied to the developing device 5Y through the supply path 43Y.

Next, the configuration and operation of the toner supply device 60Y (powder supply device) according to the present embodiment are described in further detail below.

Referring FIGS. 3 through 8B, the toner supply device 60Y according to the present embodiment includes the double-mount holder 61 and the reservoir 66.

Referring to FIGS. 5 and 7, in the double-mount holder 61, the two mounts 65 are united to each other, and the two toner containers 30Y are removably placed on the respective mounts 65. The two mounts 65 can be either molded as a single piece or jointed together. The double-mount holder 61 is configured as a unit including the two mounts 65, the two head covers 63, the end support 62 (i.e., an inner cover), and a base 64 (i.e., a tray).

As described above with reference to FIGS. 6A and 6B, the reservoir 66 is situated below the two head covers 63 and used to store the toner discharged from the two toner containers 30Y.

The double-mount holder 61 is attachable to and removable from a body 600 (illustrated in FIG. 3) of the toner supply device 60Y being in the state in which the reservoir 66 is attached to the toner supply device 60Y.

Specifically, in the toner supply device 60Y, the components of the double-mount holder 61 (enclosed by broken lines in FIGS. 3 and 4) are formed as a unit independently separable from the toner supply device 60Y. Thus, the double-mount holder 61 can be independent of the toner supply device 60Y. In other words, the double-mount holder 61 illustrated in FIG. 7 is a modular unit is removably attachable to the toner supply device 60Y (or the image forming apparatus 100).

The double-mount holder 61 in which the two mounts 65 are combined is advantageous over a configuration in which the two mounts 65 are attached and removed independently since the number of actions taken to exposed the components below the two mounts 65 are reduced. This configuration can facilitate maintenance work of the reservoir 66 and maintenance work of components, such as the exposure device 7Y, disposed below the two mounts 65.

Specifically, for the maintenance of the reservoir 66 and the exposure device 7Y, the following actions are performed. Initially, remove or open the upper cover 110 (illustrated in FIG. 1) of the apparatus that covers the upper side of the toner supply device 60Y to expose the double-mount holder 61. From above the image forming apparatus 100, grip a pair of handles 64*a* (illustrated in FIGS. 5 and 7) and lift the double-mount holder 61 to remove the double-mount holder 61 from the toner supply device 60Y (the image forming apparatus 100). Then, the reservoir 66 and the exposure device 7 situated below the double-mount holder 61 are exposed. The maintenance work of the reservoir 66 or the exposure device 7 is executed in that state.

After the maintenance work of the reservoir 66 or the exposure device 7 is completed, the above-described actions are performed in the reverse order to attach the double-mount holder 61 to the toner supply device 60Y (the image forming apparatus 100).

It is to be noted that the double-mount holder 61 can be attached to and removed from the toner supply device 60Y, either alone as illustrated in FIG. 7 or together with the toner containers 30Y mounted therein as illustrated in FIG. 5. Therefore, the above maintenance work can be facilitated further.

Referring to FIGS. 5 and 7, in the double-mount holder 61, the two head covers 63 are disposed downstream from the mount 65 in the insertion direction C. The two head covers 63 cover axial ends (including the openings 31) of the respective toner container 30Y, which are on the downstream side (distal side) in the insertion direction C. Specifically, each head cover 63 to cover the head (including the opening 31) of the toner container 30Y is disposed on the downstream side in the insertion direction C of the toner container 30Y. The head cover 63 is shaped and positioned such that the toner discharged from the toner container 30Y through the opening 31 drops to the reservoir 66.

Integrating the two head covers 63 into the double-mount holder 61 improves efficiency of the above-described maintenance work.

Additionally, referring to FIG. 7, the end support 62 is shaped, as a part of the double-mount holder 61, to cover the trailing ends (on the proximal side) of the two toner containers 30Y in the insertion direction C without hindering insertion and removal of the two toner containers 30Y into and from the two mounts 65.

The end support 62 includes screw holes 62*a* for screws to removably secure the end support 62 to either the double-mount holder 61 or the image forming apparatus 100. Specifically, via the screw holes 62*a*, the screws engage female screws provided to either the base 64 of the double-mount holder 61 or a side plate of the image forming apparatus 100, thereby securing the end support 62 to the double-mount holder 61 (the image forming apparatus 100).

It is to be noted that the double-mount holder 61 can be attached to or removed from the toner supply device 60Y from the front side of the image forming apparatus 100. Specifically, in a state in which the front cover (to be opened for insertion or removal of the toner container 30Y) of the image forming apparatus 100 is open, the screws are removed from the screw holes 62*a*, and the end support 62 is removed. Even in such as case, work efficiency is improved since the single end support 62 is configured to cover the multiple toner containers 30Y instead of providing separate end covers for the respective toner containers 30Y.

Additionally, the end support 62 includes the two entrances 62*b* for the two toner containers 30Y to be inserted into the toner supply device 60Y (the double-mount holder 61) in the insertion direction C from the front side of the image forming apparatus 100.

Additionally, decals 62*d* (illustrated in FIG. 5) are attached to an outer face (on the proximal side) of the end support 62 in the insertion direction C for color discrimination of the toner containers 30Y inserted into the end support 62.

Referring to FIGS. 5 and 7, in the present embodiment, the double-mount holder 61 includes the handles 64*a* (a pair of handles) positioned outside an area occupied by the toner containers 30Y being inserted into or removal from the mounts 65 not to hinder insertion and removal of the two toner containers 30Y. Additionally, the handles 64*a* are positioned such that the user or operator can grip the handles 64*a* in the state in which the two toner containers 30Y are on the two mounts 65.

Specifically, in the present embodiment the number of the handles 64*a* is two, and the two handles 64*a* are formed by bending lateral end portions of the base 64 (tray) in the direction perpendicular to the insertion direction C. The base 64 is planar and made of metal, for example. To the base 64, the two mounts 65, the two head covers 63, and the end support 62 are secured (for example, screwed).

With the handles 64*a* thus disposed, insertion and removal of the double-mount holder 61 are facilitated.

In particular, the image forming apparatus 100 according to the present embodiment includes the four toner supply devices 60Y, 60M, 60C, and 60K, each of which includes the double-mount holder 61. The four double-mount holders 61 are arranged side by side in the lateral direction in FIGS. 8A and 8B, which is perpendicular to the insertion direction C. To each of the four double-mount holders 61, the pair of handles 64*a* are positioned such that users or operators can grip the handles 64*a* in the state in which the two toner containers 30Y are on the two mounts 65 and the handles 64*a* do not hinder insertion and removal of the two toner containers 30Y into and from the two mounts 65.

Figure 8A:
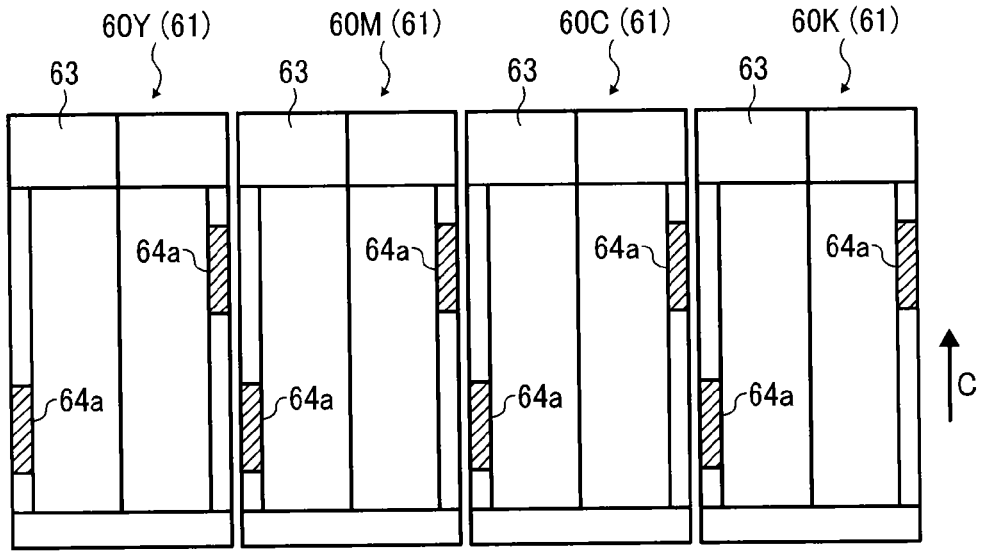
FIG. 8A is a top view of multiple two-mount holders installed in the image forming apparatus illustrated in FIG. 1.

As illustrated in FIG. 8A, the handle 64*a* (for example, on the left) of the double-mount holder 61 (the toner supply device 60K, for example) and the handle 64*a* on the adjacent side (for example, on the right) of the adjacent double-mount holder 61 (the toner supply device 60C, for example) are disposed at different positions in the insertion direction C so that the adjacent handles 64*a* do not coincide with each other in the insertion direction C. Almost all components of the double-mount holders 61 are made common among the four colors, and the bases 64 including the handles 64*a* are made common among the four colors. The two handles 64*a* are provided to the lateral ends (short side ends) of the base 64 in FIG. 8A like arms extending upright. The positions of the two handles 64*a* of the identical base 64 are different in the longitudinal direction (the vertical direction in FIG. 8A) of the toner supply device 60.

With the configuration, in which the handle 64*a* of any double-mount holder 61 is shifted from the handle 64*a* of the adjacent double-mount holder 61 as illustrated in FIG. 8A, in the state in which the upper cover 110 (in FIG. 1) of the apparatus is removed and the four double-mount holders 61 are exposed from above, efficiency and ease of work in attachment and removal of the double-mount holders 61 are improved from a configuration in which the handles 64*a* of the adjacent double-mount holders 61 coincide with each other in the longitudinal direction.

Additionally, disposing the handles 64*a* at different positions in the longitudinal direction is advantageous in that the double-mount holder 61 can be held in a balanced manner even when the double-mount holder 61 is relatively long and the center of gravity of the double-mount holder 61 is eccentric in the longitudinal direction.

Figure 8B:
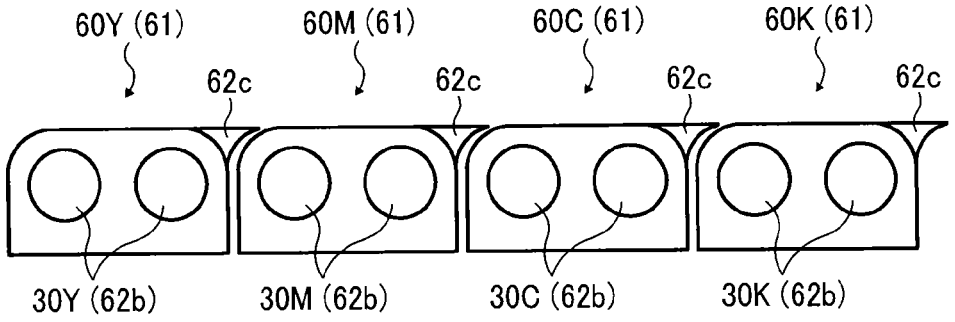
FIG. 8B is a front view of the multiple two-mount holders installed in the image forming apparatus illustrated in FIG. 8A.

Additionally, in the present embodiment, the end support 62 is removably provided to each of the four double-mount holders 61. The end support 62 covers, as an integral end support, both of the two toner containers 30Y on the trailing side (proximal side in the insertion direction C) without hindering insertion and removal of the two toner containers 30Y into and from the respective mounts 65. Referring to FIGS. 7 and 8B, the end support 62 includes a projection 62*c* to fill in clearance between the end supports 62 of the adjacent double-mount holders 61.

This configuration is advantageous in reducing the number of components and steps of assembling compared with a configuration in which a filler is separately provided to fill in the clearance between the end supports 62 of the adjacent double-mount holders 61.

It is to be noted that, in the present embodiment, the end support 62 is substantially U-shaped (upper corners are rounded, in particular), the projection 62*c* inhibits the adjacent double-mount holder 61 from moving upward. Therefore, the double-mount holder 61 is attached or removed as follows, except the double-mount holder 61 for yellow, which is the first from the left in FIG. 8A out of the four double-mount holders 61 disposed side by side. Remove the end support 62 of the double-mount holder 61 on the left, and attach or remove the double-mount holder 61 adjacent to the removed end support 62. Alternatively, pull out the double-mount holder 61, with the end support 62 attached thereto, by the distance equivalent to the thickness of the end support 62 in the direction opposite the insertion direction C (illustrated in FIG. 8A), and move the double-mount holder 61 in the vertical direction.

Alternatively, the four double-mount holders 61 may be attached and removed as follows without removing the adjacent end support 62 or pulling out the adjacent double-mount holder 61. Within the range of design limitation of the end support 62, the shape of the end support 62 is changed, for example, to a substantially rectangle or a shape such that the projection 62*c* does not overlap with the end support 62 of the adjacent double-mount holder 61 when viewed from above.

It is to be noted that, in the present embodiment, the double-mount holder 61 is attachable to and removable from the body 600 (in FIG. 3) of the toner supply device 60Y including the reservoir 66 in the vertical direction.

Figure 9A:
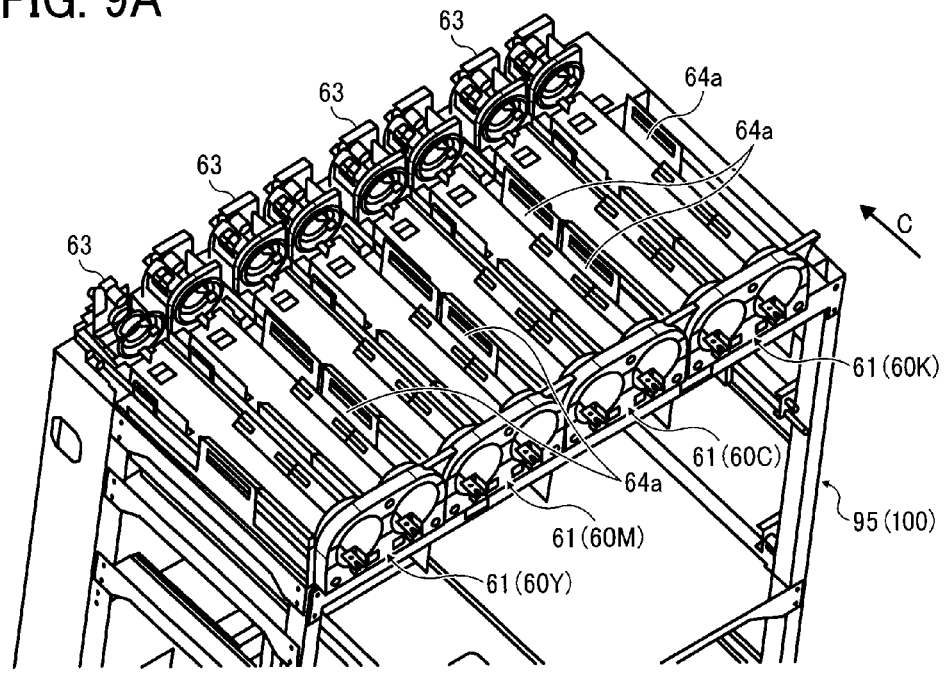
FIG. 9A is a perspective view of multiple two-mount holders mounted in an image forming apparatus according to a variation.
Figure 9B:
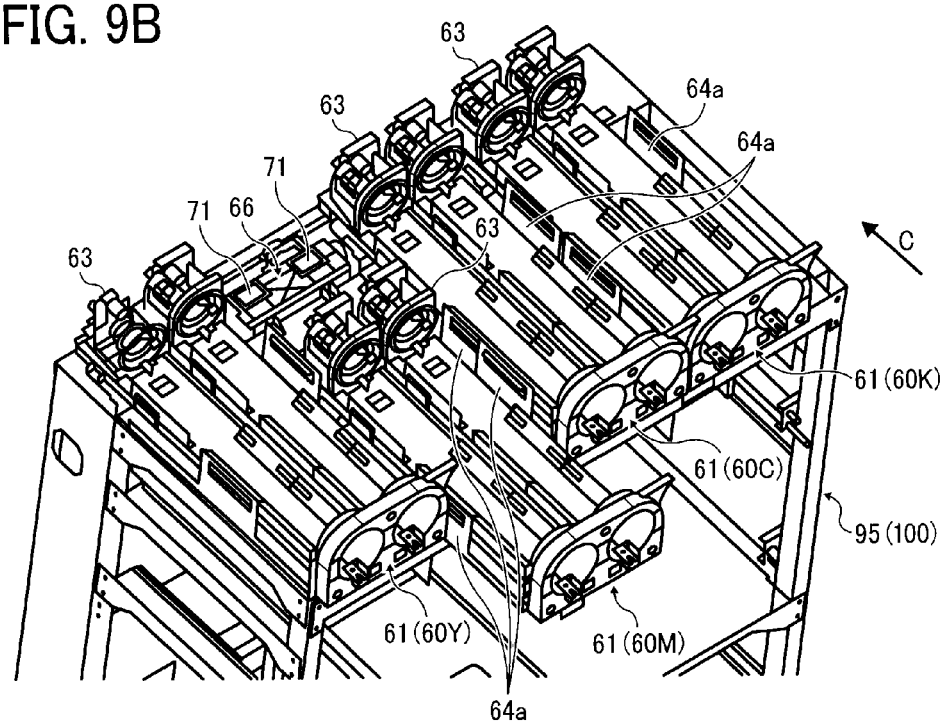
FIG. 9B is a perspective view of the image forming apparatus illustrated in FIG. 9A, from which one of the multiple two-mount holders is pulled out.

By contrast, in a variation illustrated in FIGS. 9A and 9B, the double-mount holder 61 is attachable to and removable from the body 600 of the toner supply device 60Y including the reservoir 66 in a longitudinal direction of the double-mount holder 61. That is, the direction of insertion and removal of the double-mount holder 61 into and from the image forming apparatus 100 is made identical or similar to the direction of insertion and removal of the toner container 30Y into and from the double-mount holder 61.

In the configuration illustrated in FIGS. 9A and 9B, in a housing 95 of the image forming apparatus 100, the double-mount holder 61 is insertable from a position fully inserted in the toner supply device 60Y (the reservoir 66) as illustrated in FIG. 9A to a position pulled out from the toner supply device 60Y (the reservoir 66) but still supported by the housing 95 as illustrated in FIG. 9B. Specifically, even when the double-mount holder 61 is away from the reservoir 66 by a predetermined distance (such that the one of the handles 64*a* is exposed and the center of gravity of the double-mount holder 61 is above the housing 95), the double-mount holder 61 does not slip off but is held on the image forming apparatus 100.

In this configuration, the housing 95 includes a slide face on which the double-mount holder 61 slides from the position illustrated in FIG. 9B (held on the housing 95) in the longitudinal direction to the position connected to the reservoir 66 as illustrated in FIG. 9A. This configuration facilitates insertion and removal of the double-mount holder 61. In particular, even when the double-mount holder 61 is heavy, the double-mount holder 61 is easily aligned in position relative to the reservoir 66.

Additionally, also in the configuration illustrated in FIGS. 9A and 9B, disposing the handles 64*a* at different positions in the longitudinal direction is advantageous in that the double-mount holder 61 can be held in a balanced manner even when the double-mount holder 61 is relatively long and the center of gravity of the double-mount holder 61 is eccentric in the longitudinal direction. It is to be noted that, to secure this effect, it is preferable that the center of gravity of the double-mount holder 61 is positioned between the two handles 64*a* in the longitudinal direction of the double-mount holder 61.

Figure 10:
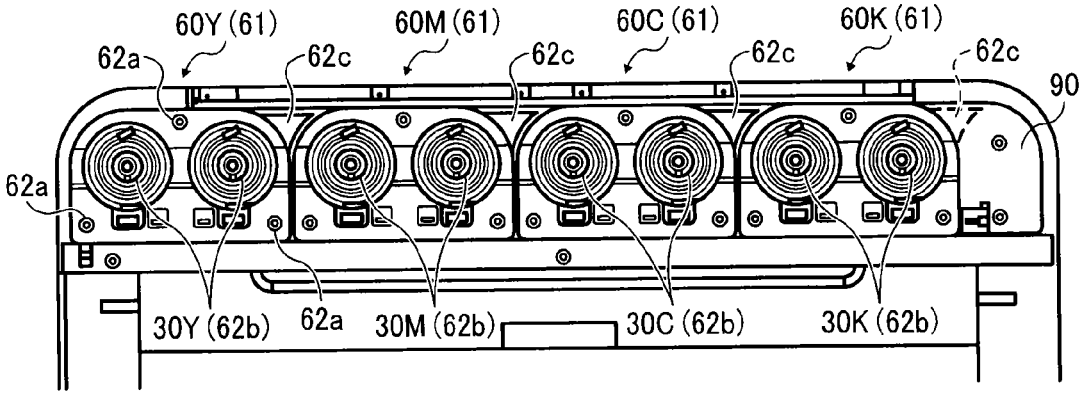
FIG. 10 is a front view of multiple two-mount holders installed in an image forming apparatus according to another variation.

In another variation, as illustrated in FIG. 10, an exterior cover 90 of the image forming apparatus 100 is shaped to cover the projection 62*c* of the end support 62 of the double-mount holder 61 (of the toner supply device 60K) situated at the first from the right in FIG. 10 among the four double-mount holders 61, as viewed from the upstream side (proximal side) in the direction of insertion of the toner container 30.

This configuration improves the appearance of the entrances 62*b* and adjacent areas of the toner supply devices 60Y, 60M, 60C, and 60K, which are exposed from the image forming apparatus 100 when the toner containers 30 are replaced.

As described above, according to the above-described embodiments, the toner supply device 60Y includes the double-mount holder 61 (single holder) to hold the two toner containers 30Y (powder containers) and the reservoir 66 to store the toner (powder) that flows down from the two toner containers 30Y. In the double-mount holder 61, the two mounts 65 are formed integrally, and the two toner containers 30Y are removably mounted on the two mounts 65. The double-mount holder 61 is attachable to and removable from the toner supply device 60Y in the state in which the reservoir 66 is mounted in the toner supply device 60Y (powder supply device). This configuration can facilitate maintenance work of the reservoir 66 and maintenance work of components of the image forming apparatus 100, such as the exposure device 7Y, disposed below the two mounts 65.

It is to be noted that, although the descriptions above concern the toner containers 30, aspects of this specification can adapt to powder containers to contain other types of powder or powder including toner. It is to be noted that, although the toner containers 30Y, 30M, 30C, and 30K contain toner in the above-described embodiments, alternatively, the toner containers 30Y, 30M, 30C, and 30K may contain two-component developer including toner and carrier when used in image forming apparatuses that supply two-component developer to developing devices.

Additionally, although the multiple toner containers 30 including the substantially cylindrical, rotatable container bodies are remarkably installed in the toner supply device 60Y in the description above, the shape of the toner containers 30 are not limited thereto. The aspects of this specification can adapt to toner supply devices to which, for example, multiple box-shaped toner containers are mounted.

Additionally, the supply destination is not limited to the developing devices 5. The aspects of this specification can adapt to toner supply devices to supply toner to a component, such as a temporary container (i.e., as sub-hopper) disposed in a supply route between the toner supply device 60Y and the developing device 5Y.

Additionally, although the descriptions above concern the powder supply devices to supply powder from the reservoir 66 via the supply path 43 to the developing device 5, the aspects of this specification can adapt to toner supply devices to supply toner from the reservoir 66 directly to the developing device 5.

Additionally, although the description above concerns the image forming apparatus 100 employing the toner supply device 60 to which the two toner containers 30 are mounted for each of the multiple different color toners, the number of toner containers used for an identical color toner is not limited two but can be three or more. Additionally, the aspects of this specification can adapt to single color image forming apparatuses in which multiple toner containers are mounted for an identical color toner.

In such configurations, effects similar to those described above are also attained.

Additionally, the embodiments described above employ the four double-mount holders 61, each of which is removably mounted independently for the corresponding color to facilitate the maintenance work of the reservoir 66 or the exposure device 7 for each color. By contrast, in another embodiment, the image forming apparatus employs a single holder to hold the respective toner containers 30 of all of the four colors (eight toner containers in total in the above-described embodiments). Such a configuration is advantageous in a case where overall work efficiency is improved by executing maintenance of all colors at a time. One example is a configuration in which the intermediate transfer device 15 including the intermediate transfer belt 8 is situated between the four toner supply devices 60 and the image forming units 6.

In such configurations, effects similar to those described above are also attained.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. A powder supply device to supply powder to a supply destination, the powder supply device comprising:

a body;

a single holder including multiple mounts on which multiple powder containers are removably mounted respectively, and a reservoir disposed in the body and below the single holder, to store powder discharged from the multiple powder container, wherein the single holder is removably attachable to the body of the powder supply device including the reservoir.

2. The powder supply device according to claim 1, wherein the single holder comprises a handle disposed outside an area occupied by the multiple powder containers being inserted into or removed from the powder supply device, the handle projecting upward from an end of the single holder in a lateral direction perpendicular to a container insertion direction in which the multiple powder containers are inserted into the powder supply device.

3. The powder supply device according to claim 1, wherein each of the multiple powder containers comprises a substantially cylindrical container body that is rotatable, the container body including a spiral protrusion protruding to an inner circumferential face of the container body, the single holder includes multiple downstream end covers to cover downstream ends of the multiple powder containers in a container insertion direction in which the multiple powder containers are inserted into the powder supply device, the downstream ends including openings to discharge the powder from the multiple powder containers, and the reservoir is disposed below the multiple downstream end covers and communicates with the openings of the multiple powder containers.

4. The powder supply device according to claim 3, wherein the single holder comprises an upstream end support positioned on an upstream side of the single holder in the container insertion direction to support an upstream side of each of the multiple powder containers, and the upstream end support includes multiple entrances through which the multiple powder containers are inserted into and removed from the powder supply device.

5. The powder supply device according to claim 1, wherein the single holder is removably inserted from an open end of an upper part of the powder supply device into the powder supply device in a longitudinal direction of the single holder.

6. The powder supply device according to claim 1, wherein the powder comprises toner, the supply destination is a developing device to develop a latent image into a toner image with the toner, and the developing device communicates either directly or indirectly with the reservoir to receive the toner from the reservoir.

7. An image forming apparatus comprising:

an image bearer;

the powder supply device according to claim 1; and a developing device to develop a latent image on the image bearer, the developing device being the supply destination, wherein the powder supplied by the powder supply device includes toner.

8. An image forming apparatus comprising:

multiple powder supply devices to supply powder to respective supply destinations, each of the multiple powder supply device including:

a body;

a holder including multiple mounts on which multiple powder containers are removably mounted respectively, and a reservoir disposed in the body and below the holder, to store powder discharged from the multiple powder containers, wherein the holder of each of the multiple powder supply devices is removably attachable to the body of each of the multiple powder supply devices including the reservoir, the holders of the multiple powder supply devices are arranged in a lateral direction perpendicular to a container insertion direction in which the multiple powder containers are inserted into the powder supply devices, the holder of each of the multiple powder supply devices includes a first handle and a second handle disposed outside an area occupied by the multiple powder containers being inserted into or removed from the multiple mounts, and the first handle and the second handle project upward from ends of the holder of each of the multiple powder supply devices in the lateral direction and are disposed at different positions from each other in the container insertion direction.

9. The image forming apparatus according to claim 8, wherein the holder of each of the multiple powder supply devices comprises an upstream end support positioned on an upstream side of the holder in the container insertion direction to support an upstream side of each of the multiple powder containers, and the upstream end support includes:

multiple entrances through which the multiple powder containers are inserted into and removed from the powder supply devices; and a projection to fill in clearance between the upstream end supports of the holders of the multiple powder supply devices adjacent to each other.

* * * * *